US007896189B2

(12) United States Patent
Griffin

(10) Patent No.: US 7,896,189 B2
(45) Date of Patent: Mar. 1, 2011

(54) COMBINATION DRINK DISPENSER

(76) Inventor: Jason Griffin, San Diego, CA (US)

( * ) Notice: Subject to any disclaimer, the term of this patent is extended or adjusted under 35 U.S.C. 154(b) by 1128 days.

(21) Appl. No.: 11/604,041

(22) Filed: Nov. 24, 2006

(65) Prior Publication Data

US 2008/0123464 A1 May 29, 2008

(51) Int. Cl.
*B01F 11/00* (2006.01)

(52) U.S. Cl. ..... 220/568; 220/676; 206/219; 266/130

(58) Field of Classification Search ..... 220/568, 220/676; 206/219; 366/130
See application file for complete search history.

(56) References Cited

U.S. PATENT DOCUMENTS

| | | | | | |
|---|---|---|---|---|---|
| 53,965 | A * | 4/1866 | Fisler | 366/130 |
| 288,775 | A * | 11/1883 | Cherry | 220/568 |
| 300,867 | A * | 6/1884 | Hauck | 220/568 |
| 950,288 | A * | 2/1910 | Heinriches | 220/568 |
| 1,042,751 | A * | 10/1912 | Barker | 220/568 |
| 1,054,833 | A * | 3/1913 | Dutton | 220/568 |
| 1,056,882 | A * | 3/1913 | Bonn | 215/386 |
| 1,141,207 | A * | 6/1915 | Parent | 210/469 |
| 1,765,129 | A * | 6/1930 | Cooke | 220/568 |
| 2,090,320 | A * | 8/1937 | Amick | 215/12.1 |
| 2,330,012 | A * | 9/1943 | Schlumbohm | 210/464 |
| 2,433,248 | A * | 12/1947 | Sweier, Jr. | 366/147 |
| 2,752,971 | A * | 7/1956 | Tupper | 220/4.03 |
| 3,327,911 | A * | 6/1967 | Candito | 222/572 |
| 3,820,692 | A * | 6/1974 | Swett et al. | 222/547 |
| 4,003,555 | A * | 1/1977 | Swartz | 366/130 |
| 5,275,307 | A * | 1/1994 | Freese | 222/42 |
| 5,388,729 | A * | 2/1995 | Gerringer | 222/130 |
| 5,419,429 | A * | 5/1995 | Zimmerman et al. | 206/222 |
| 6,224,253 | B1 * | 5/2001 | Dixon | 366/247 |
| D503,304 | S * | 3/2005 | Fiedeler et al. | D7/300.1 |
| 6,913,165 | B2 * | 7/2005 | Linz et al. | 220/568 |
| 7,225,920 | B2 * | 6/2007 | Hoeffkes et al. | 206/222 |
| D604,984 | S * | 12/2009 | Kalamaras | D7/300.1 |
| 2003/0214140 | A1 * | 11/2003 | Lynd | 294/27.1 |
| 2006/0255035 | A1 * | 11/2006 | Lin | 220/212 |

* cited by examiner

*Primary Examiner*—Anthony Stashick
*Assistant Examiner*—Christopher B McKinley
(74) *Attorney, Agent, or Firm*—QuickPatents, Inc.; Kevin Prince

(57) ABSTRACT

Disclosed is a combination drink dispenser enabling shaking and straining of flowable materials in an easy, quick, inexpensive, and efficient manner at home as well as in commercial places. The combination drink dispenser comprises a first container and a second container detachably positionable on the first container. The first container having a first closed end portion, a second open end portion, a curved body extending from the first closed end portion to the second open end portion, and an edge having a plurality of differently sized openings, the edge extending from a periphery of the second open end portion. The second container having a first closed end portion, a second open end portion, and a curved body extending from the first closed end portion to the second open end portion. The combination drink dispenser enabling shaking of flowable material therewithin and straining the flowable material through the openings.

1 Claim, 2 Drawing Sheets

COMBINATION DRINK DISPENSER

FIELD OF THE INVENTION

The present invention relates in general to multipurpose vessels and more specifically to a combination drink dispenser capable of enabling shaking and straining flowable materials in an easy, quick, and efficient manner.

BACKGROUND OF THE INVENTION

Most of the mixed drinks require the inherent use of a shaker to properly make them. People maybe seen at home or commercial places using shakers to prepare such drinks. Conventional shakers generally comprises two container, such that one container covers the hollow space of the other container thereby creating an arrangement that may be used for making shake drink. Usually the hollow space between the two containers receives liquids and/or solids, such as ice, fruit, herb, and the like, to be mixed. After shaking the drink material inside the shaker, the drink needs to be strained out generally with the help of separate strainer which may be time consuming and inefficient at times. There are some shakers available with strainer or filter arrangement which may be selectively closed during mixing and opened upon the completion of mixing to permit the mixed drink to be poured from the container, without spilling the ingredients intended to remain back in the container. But such types of strainers are complex, expensive and need efficient hands to operate. Attempts have been made to address this problem.

U.S. Pat. No. 5,419,429 discloses a mixing and drinking beaker with an adhesive, closing and sealing system between the cover and the beaker and with a chamber in the cover consisting of an outer cover and an inner cover therein after the adhesive and sealing system. The inner cover can be released from its seat without releasing the joint between the cover and the beaker without the need for any additional mechanism simply by the yielding of sealing seat of the material surrounding the inner cover by pressure from outside axially to the outer cover on the handle and/or the surrounding area of the outer cover. In addition, the adhesive bond between the cover and the beaker can be changed to a positive bond by a shrink strip. The above approach is limited to shaking and cannot perform the function of filtering.

U.S. Pat. No. 6,913,165 discloses a cocktail shaker which has a head adapted for releasably sealing an insulated container, having at least one plastic wall, where the container may be used as a drinking vessel. The cocktail shaker head has a metal selectively closeable strainer or filter portion and an integral reinforcement body portion carrying a flexible sealing gasket which has multiple ribs for releasably sealing the shaker top onto the container. The container has double insulating walls including a standoff within the walls spacing the walls apart, and a smooth metallic lip seal joining the walls together to create a smooth lip on the container, and which is adapted to receive the shaker top sealing gasket. The plastic and metal portions of the shaker head and container have shoulder stepped connections for securing the respective plastic and metal parts together. The cocktail shaker of the above approach is complex, expensive and will need good maintenance.

Accordingly, there remains a need for a multipurpose drink dispenser capable of enabling shaking and straining of flowable materials in an easy, quick, inexpensive, and efficient manner at home as well as in commercial places.

SUMMARY OF THE INVENTION

In view of the foregoing disadvantages inherent in the prior art, the general purpose of the present invention is to provide a combination drink dispenser configured to include all the advantages of the prior art, and to overcome the drawbacks inherent therein.

In an aspect, the present invention provides a combination drink dispenser. The combination drink dispenser comprises a first container and a second container detachably positionable on the first container. The first container and the second container configure an arrangement enabling shaking and straining of a flowable material.

In another aspect, the present invention provides a combination drink dispenser, comprising a first container and a second container. The first container having a first closed end portion, a second open end portion, a curved body extending from the first closed end portion to the second open end portion, the curved body configuring an interior space therein, a periphery of the second open end portion greater than a periphery of the first closed end portion, and an edge extending from the periphery of the second open end portion and configuring a third open end portion. The second container having a first closed end portion, a second open end portion, and a curved body extending from the first closed end portion to the second open end portion, the curved body configuring an interior space therein, a periphery of the second open end portion greater than a periphery of the first closed end portion. The second container detachably positionable on the first container in a manner, such that, the first container and the second container configures an arrangement enabling shaking and straining of a flowable material.

In yet another aspect, the present invention provides a method for shaking and straining flowable material from a combination drink dispenser. The method comprises: receiving a mixture of flowable material in a first container, the first container having a first closed end portion, a second open end portion, a curved body extending from the first closed end portion to the second open end portion, and an edge extending from the periphery of the second open end portion and configuring a third end portion, the edge having a plurality of differently sized openings spread across a complete periphery of the edge; inverting a second container over the first container, the second container having a first closed end portion, a second open end portion, and a curved body extending from the first closed end portion to the second open end portion, such that, the second open end portion of the second container positions on the second open end portion of the first container, thereby covering the first container and enabling shaking of the mixture of flowable material therewithin; and inclining the first container in a manner such that the mixture of flowable material strains through the plurality of differently sized holes on the edge.

BRIEF DESCRIPTION OF THE DRAWINGS

The advantages and features of the present invention will become better understood with reference to the following more detailed description and claims taken in conjunction with the accompanying drawings, wherein like elements are identified with like symbols, and in which:

Like reference numerals refer to like parts throughout the description of several views of the drawings.

DETAILED DESCRIPTION OF THE INVENTION

The exemplary embodiments described herein detail for illustrative purposes are subject to many variations in structure and design. It should be emphasized, however, that the present invention is not limited to a particular shaker vessel, as shown and described. It is understood that various omissions, substitutions of equivalents are contemplated as circumstances may suggest or render expedient, but is intended to cover the application or implementation without departing from the spirit or scope of the claims of the present invention.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present invention provides a multipurpose combination drink dispenser that has functionality of both a shaker and as a strainer. The combination drink dispenser configures an arrangement that may be used for making drinks, such as, but not limited to mock tail, cocktail, martini and the like. The combination drink dispenser of the present invention provides an easy, quick, and efficient way of making such drinks at home as well as in commercial places. The combination drink dispenser may be mass produced inexpensively with different shape, size and color. The material used for manufacturing the multipurpose shaker vessel may include plastic, steel, aluminum, and the like.

Figure 1:
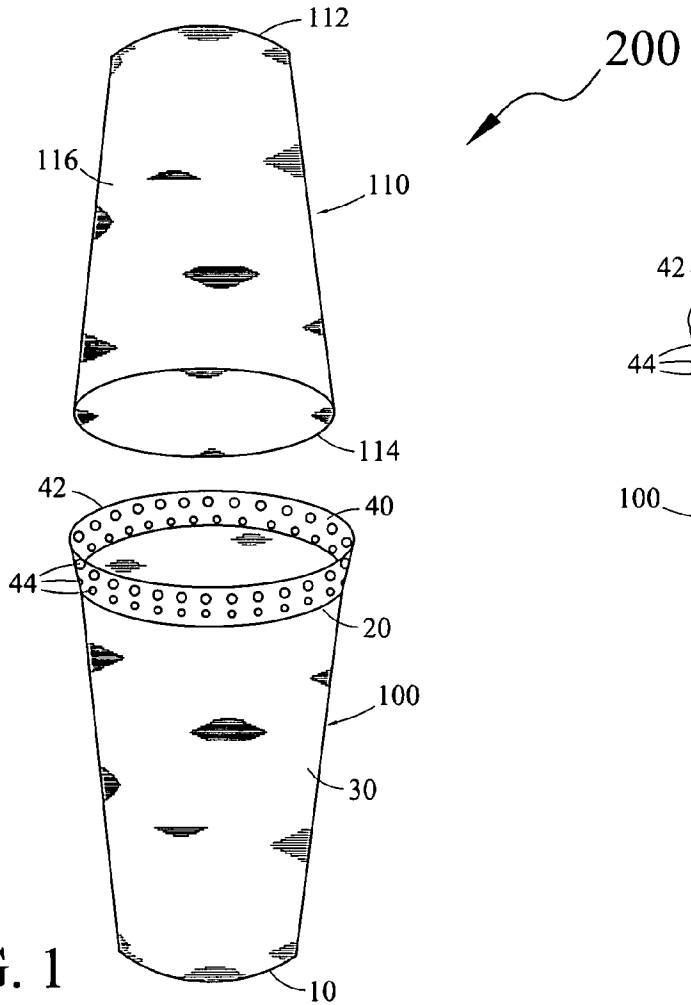
FIG. 1 is a perspective view of a combination drink dispenser 200 having a first container 100 and a second container 110, according to an exemplary embodiment of the present invention.

Referring to FIG. 1, illustrated is one exemplary embodiment of a combination drink dispenser 200 of the present invention. The combination drink dispenser 200 may comprise a first container 100 and a second container 110. The second container 110 may be positioned upon the first container 100 thereby configuring an arrangement, in a manner, such that, the combination drink dispenser 200 enables shaking and straining of flowable material. The first container 100 and the second container 110 may be made up of same material or may be of different materials.

Figure 2:
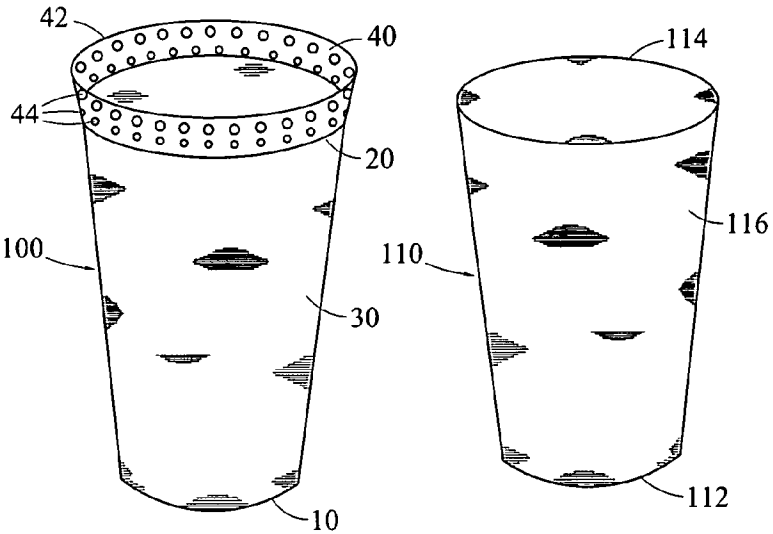
FIG. 2 is a perspective view of the first container 100 and the second container 110, the first container 100 having a plurality of differently sized openings 44 across a complete periphery of an edge 40, according to an exemplary embodiment of the present invention.

Now, referring to FIG. 2, illustrated are the perspective views of an exemplary embodiment of the first container 100 and the second container 110 of the present invention. The first container 100 may have a first closed end portion 10, a second open end portion 20 and a curved body 30. The curved body 30 extends from the first closed end portion 10 to the second open end portion 20 thereby configuring an interior space therein. Furthermore, the second open end portion 20 configures a periphery greater than a periphery of the first closed end portion 10. The first container 100 may further have an edge 40 extending from the periphery of the second open end portion 20 and configures a third open end portion 42. The periphery of the third open end portion 42 is greater than the periphery of the second open end portion 20. The edge further may have a plurality of differently sized openings 44 spread across the complete periphery of the edge 40.

The second container 110 may have a first closed end portion 112, a second open end portion 114 and a curved body 116. The curved body 116 may extend from the first closed end portion 112 to the second open end portion 114 thereby configuring an interior space therein. Furthermore, the second open end portion 114 configures a periphery greater than a periphery of the first closed end portion 112. The periphery of the second open end portion 114 of the second container 110 is equivalent to the periphery of the second open end portion 20 of the first container 100. The curved body 116 may be configured in shapes such as, circular, rectangular, hexagonal, elliptical, and the like, depending upon the geometry of the curved body 30 of the first container 100.

Figure 3B:
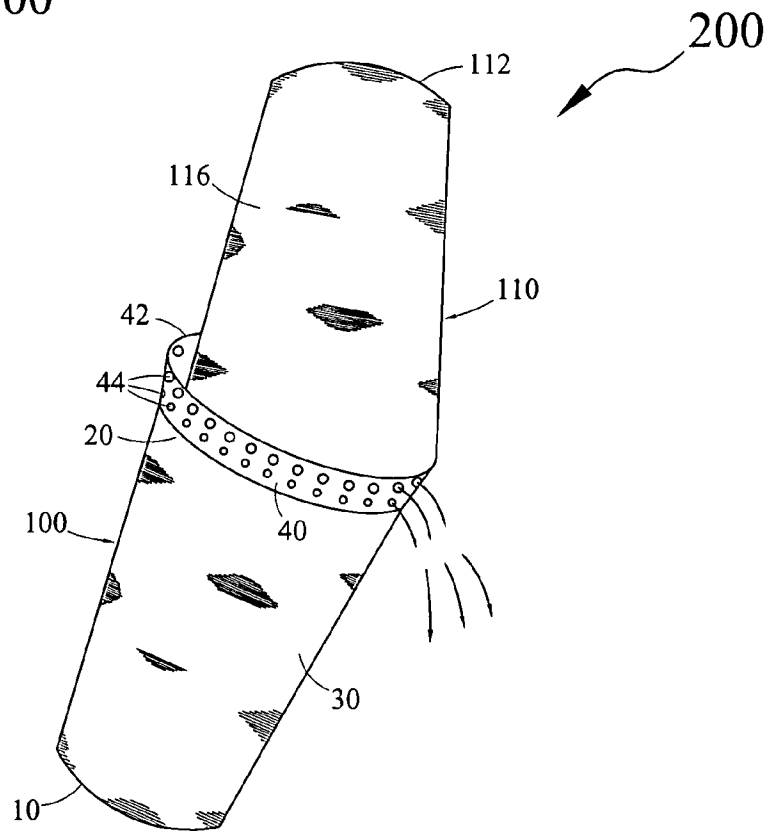
FIG. 3B is a perspective view of the combination drink dispenser 200 illustrating an arrangement enabling straining the flowable material subsequent to shaking, through the plurality of differently sized openings 44, according to an exemplary embodiment of the present invention.
Figure 3A:
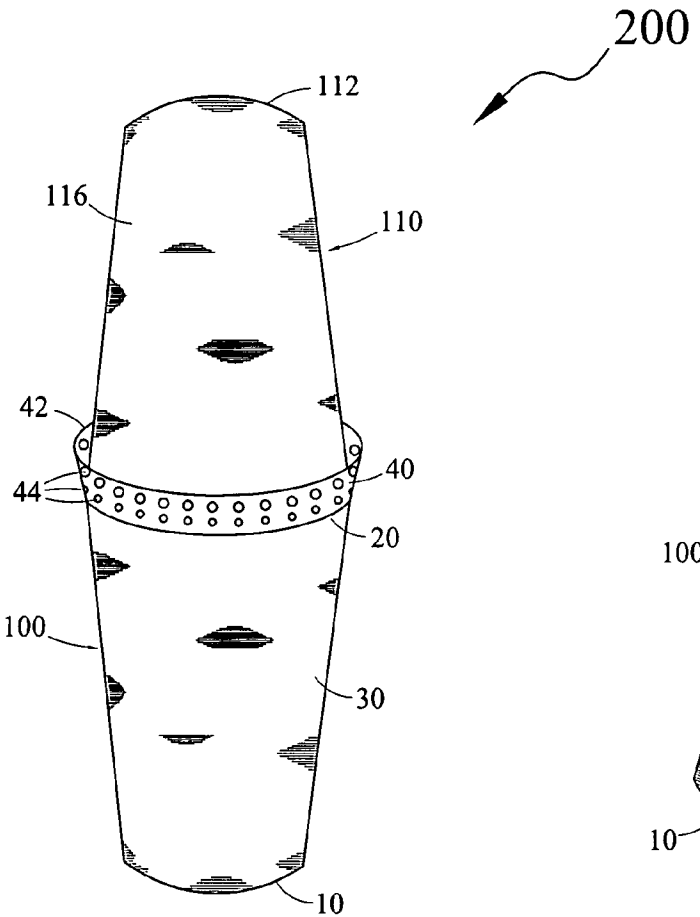
FIG. 3A is a perspective view of the combination drink dispenser 200 illustrating an arrangement enabling shaking of flowable material received within the first container 100 and covered by the second container 110, according to an exemplary embodiment of the present invention.

Referring to FIGS. 3A and 3B, illustrated is arrangement for qualifying the functionality of the combination drink dispenser 200 involving shaking and straining of flowable material received within the first container 100 or the second container 110. For the purposes of shaking, the flowable material alongwith the required solid material may be received within the interior space of first container 100 or the second container 110. As shown in FIG. 3A, if the mixture of the flowable material is received within the interior space of the first container 100, then, for the purposes of shaking the mixture, the second open end portion 114 of the second container 110 may be inverted upon the second open end portion 20 of the first container 100, in a manner, such that, the inverted second container 110 covers the first container 100 but only excluding the edge 40 from covering. The equivalent periphery of the second open end portion 114 of the second container 110 and the periphery of the second open end portion 20 of the first container 100 enables the complete covering of the first container 100, so that when the mixture within the interior space is shaken by a user, the mixture gets properly mixed therewithin without spilling over.

As illustrated in FIG. 3B, once the complete shaking of the flowable mixture is performed, the first container 100 may be inclined to an extent, such that, the mixture within the interior space is capable of flowing out of the combination drink dispenser 200 through the plurality of differently sized openings 44 on the edge 40 of the first container 100, at the same time stopping any spill over from the third open end portion 42. The smaller openings may result in more smooth and strained flow of the flowable material containing fewer granules compared to the large openings. The first container 100 and the second container 110 may be interchanged for receiving a mixture of flowable material and inverting and closing the mixture of flowable material for the purposes of shaking.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is understood that various omissions, substitutions of equivalents are contemplated as circumstance may suggest or render expedient, but is intended to cover the application or implementation without departing from the spirit or scope of the claims of the present invention.

What is claimed is:

1. A method for shaking and straining flowable material, the method comprising:

receiving a mixture of flowable material in a first container, the first container having a first closed end portion, a second open end portion, a curved body extending from the first closed end portion to the second open end portion, and an edge extending from the periphery of the second open end portion and configuring a third end portion, the edge having a plurality of differently sized holes spread across a complete periphery of the edge, the plurality of differently sized holes comprising a plurality of large openings and a plurality of small openings, each of the plurality of differently sized holes flat against the surface of the edge of the first container;

inverting a second container over the first container, the second container having a first closed end portion, a second open end portion, and a curved body extending from the first closed end portion to the second open end portion, such that, the second open end portion of the second container positions on the second open end portion of the first container, thereby covering the first container and enabling shaking of the mixture of flowable material therewithin; and inclining the first container in a manner such that the mixture of flowable material strains through the plurality of differently sized holes on the edge.

* * * * *